US006168259B1

(12) United States Patent
Capurso

(10) Patent No.: US 6,168,259 B1
(45) Date of Patent: Jan. 2, 2001

(54) PRINTER FOR FORMING A FULL-WIDTH IMAGE ON A RECEIVER EXCLUSIVE OF A TRANSVERSE SIDE OF THE RECEIVER, AND METHOD OF ASSEMBLING THE PRINTER

(75) Inventor: Robert G. Capurso, Bergen, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/169,054

(22) Filed: Oct. 9, 1998

(51) Int. Cl.[7] ..... B41J 2/165

(52) U.S. Cl. ..... 347/36; 347/76

(58) Field of Search ..... 347/36, 55, 76

(56) References Cited

U.S. PATENT DOCUMENTS

| | | | | |
|---|---|---|---|---|
| 4,126,090 | | 11/1978 | McKay | 101/348 |
| 4,823,150 | | 4/1989 | Kage et al. | 400/126 |
| 5,196,863 | | 3/1993 | Palmer et al. | 347/171 |
| 5,534,896 | | 7/1996 | Osborne | 347/29 |
| 5,966,145 | * | 10/1999 | Miura et al. | 347/9 |
| 6,019,466 | * | 10/1999 | Hermanson | 347/104 |

FOREIGN PATENT DOCUMENTS

| | | | | |
|---|---|---|---|---|
| 4-04187440 | * | 7/1992 | (JP) | 347/75 |

* cited by examiner

*Primary Examiner*—N. Le
*Assistant Examiner*—Shih-wen Hsieh
(74) *Attorney, Agent, or Firm*—Walter S. Stevens

(57) ABSTRACT

A printer for forming a full-width image on a receiver exclusive of a transverse side of the receiver, and method of assembling the printer. The printer comprises an ink jet print head adapted to eject a plurality of ink droplets onto a receiver sheet for forming an image that extends a full-width of the receiver sheet. To achieve this result, the print head commences ejection of ink droplets beginning at a predetermined distance from a transverse side of the receiver sheet. A reservoir is disposed adjacent the transverse side and along the predetermined distance for collecting ink droplets ejected along the predetermined distance, so that none of the ink droplets are inadvertently deposited onto the transverse side or onto components housed in the printer. In a preferred embodiment of the invention, the reservoir is an absorbent material that absorbs the ink droplets ejected along the predetermined distance. Alternatively, the reservoir can be a drain for collecting the ink droplets ejected along the predetermined distance. As another alternative, the ink droplets are caused to possess an electrostatic charge of a first polarity and the reservoir is caused to possess an electrostatic charge of a second polarity opposite the first polarity, so that the ink droplets ejected along the predetermined distance are preferentially attracted to the reservoir.

24 Claims, 9 Drawing Sheets

PRINTER FOR FORMING A FULL-WIDTH IMAGE ON A RECEIVER EXCLUSIVE OF A TRANSVERSE SIDE OF THE RECEIVER, AND METHOD OF ASSEMBLING THE PRINTER

BACKGROUND OF THE INVENTION

This invention generally relates to ink jet printers and methods and more particularly relates to an ink jet printer for forming a full-width image on a receiver exclusive of a transverse side of the receiver, and method of assembling the printer.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

Traditionally, prints were made with a blank border surrounding the printed image. However, today there is an established market for so-called "borderless" (i.e., full-width) prints. Borderless prints are aesthetically desirable because distracting borders around the image are nonexistent. Also, misaligned images cause uneven borders which are undesirable. Moreover, prints that are borderless when printed conserve print stock because there is then no need to trim-away the distracting border which would otherwise surround the image.

A prior art technique for producing borderless prints is simply to begin operating a print head such that ink droplets commence ejection at a predetermined distance before the print head aligns with a marginal edge of the receiver. This prior art technique avoids the previously mentioned borders and thus provides borderless prints.

However, use of this prior art technique gives rise to a problem. That is, when the print head is operated in this manner, ink droplets will also deposit onto a transverse side of the receiver and may even migrate to an underside of the receiver. Deposit of ink onto the transverse side as well as onto the underside of the receiver detracts from aesthetic enjoyment of the image.

Moreover, commencing ejection of ink before the print head aligns with the marginal edge gives rise to yet another problem. In this regard, ink droplets not deposited onto the receiver are deposited elsewhere within the printer. Deposit of ink elsewhere in the printer may contaminate components contained in the printer, a highly undesirable result. It is therefore important to capture ink droplets not deposited onto the receiver during borderless printing, so that these ink droplets can be later easily removed from the printer for disposal or recycling.

Therefore, there is need to provide a printer for forming a full-width image on a receiver exclusive of a transverse side of the receiver, and method of assembling the printer, such that inadvertent deposit of ink on the transverse side and elsewhere in the printer is avoided.

SUMMARY OF THE INVENTION

An object of the present invention is to provide a printer for forming a full-width image on a receiver exclusive of a transverse side of the receiver, and method of assembling the printer.

With this object in view, the present invention resides in a printer for forming an image on a receiver exclusive of a transverse side of the receiver, comprising a print head adapted to eject an image-forming fluid commencing a predetermined distance from the transverse side for forming the image on the receiver exclusive of the transverse side of the receiver; and a reservoir associated with said print head and extending along the predetermined distance for receiving the fluid ejected along the predetermined distance, so that the transverse side is fluid-free.

According to an exemplary embodiment of the invention, the printer comprises a print head adapted to eject a plurality of ink droplets onto a receiver sheet, so as to form an image that can extend a full-width of the receiver sheet. Full-width printing obtains so-called "borderless" prints which are aesthetically pleasing to the viewer of the print. The terminology "borderless print" is defined herein to mean a print without a blank border surrounding the image formed on the receiver sheet. To achieve this result, the print head commences ejection of ink droplets a predetermined distance before reaching a transverse side of the receiver sheet. As used herein, the terminology "transverse side" is defined to mean that side of the receiver sheet that is seen when the receiver sheet is viewed transversely.

A reservoir is disposed adjacent the transverse side and extends along the predetermined distance for receiving ink droplets ejected along the predetermined distance, so that none of the ink droplets are inadvertently deposited onto the transverse side or onto components housed in the printer. In a preferred embodiment of the invention, the reservoir is an absorbent material that absorbs the ink droplets ejected along the predetermined distance. In a second embodiment of the invention, the reservoir is a drain for collecting the ink droplets ejected along the predetermined distance. In a third embodiment of the invention, the ink droplets are caused to possess an electrostatic charge of a first polarity and the reservoir is caused to possess an electrostatic charge of a second polarity opposite the first polarity, so that the ink droplets ejected along the predetermined distance are preferentially attracted to the reservoir.

A feature of the present invention is the provision of a reservoir for capturing ink droplets ejected along the predetermined distance.

An advantage of the present invention is that use thereof provides borderless prints without transverse side ink contamination in order to enhance aesthetic enjoyment of the image formed on the receiver sheet.

Another advantage of the present invention is that use thereof avoids ink contamination of components within the printer.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
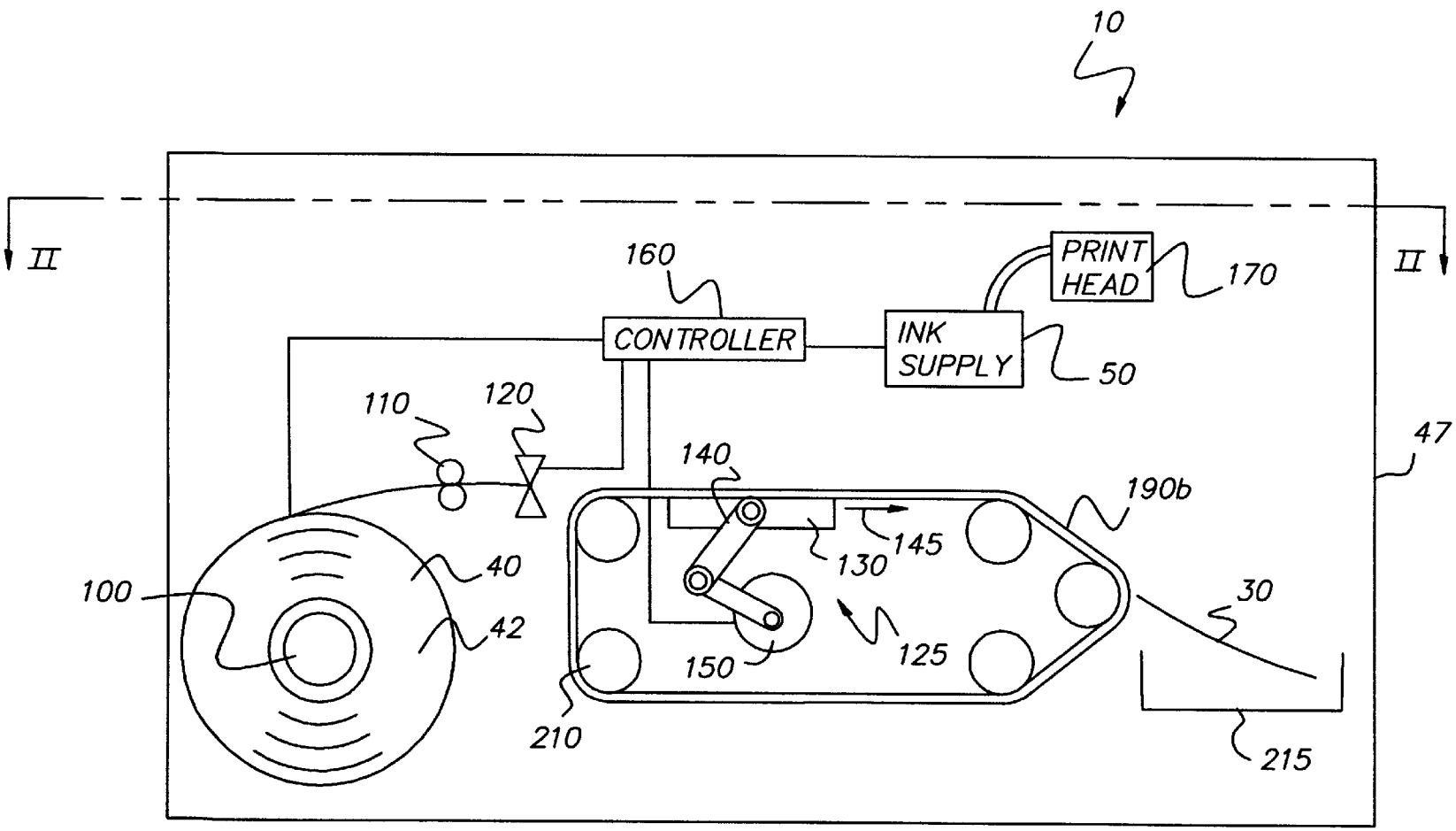
FIG. 1 a view in elevation of a printer belonging to the present invention.
Figure 2:
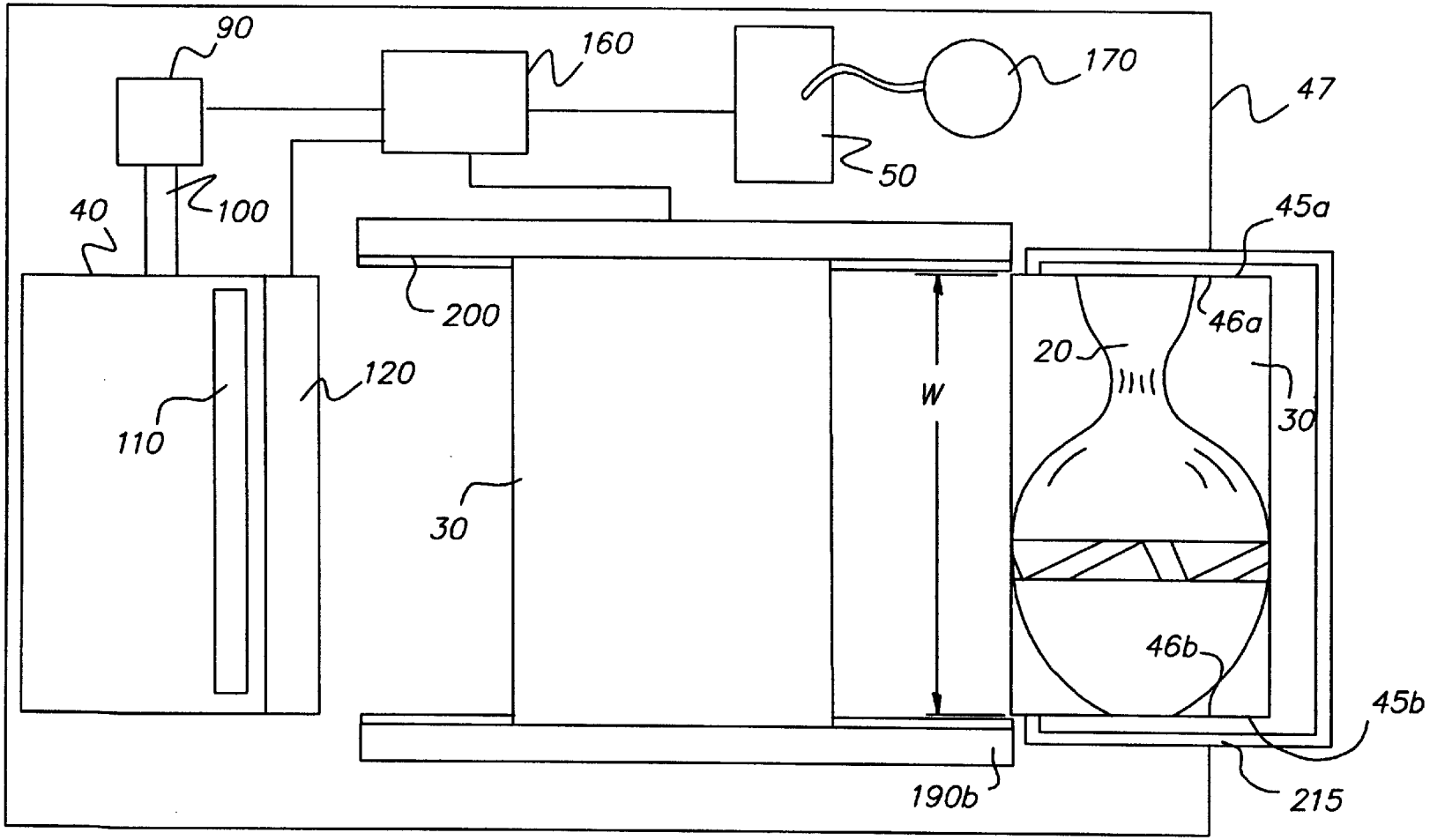
FIG. 2 is a view in plan of the printer taken along section line 2—2 of FIG. 1.
Figure 3B:
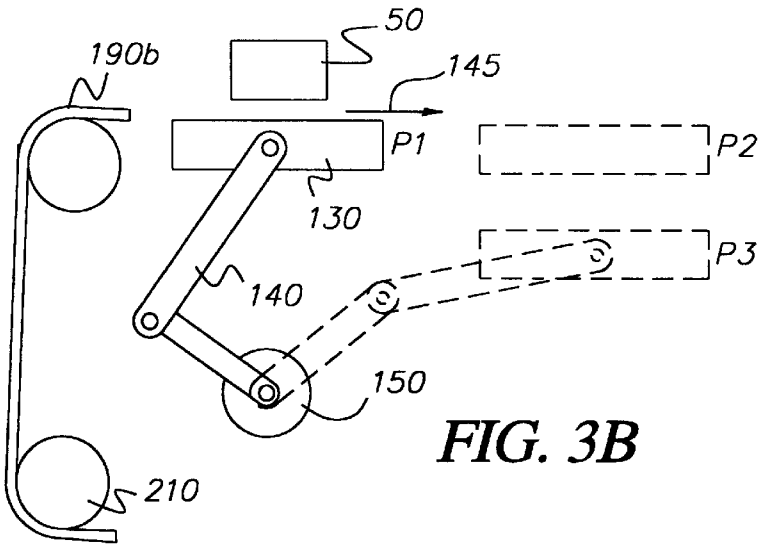
FIGS. 3A, 3B and 3C are views in elevation of a receiver sheet transport mechanism.
Figure 3A:
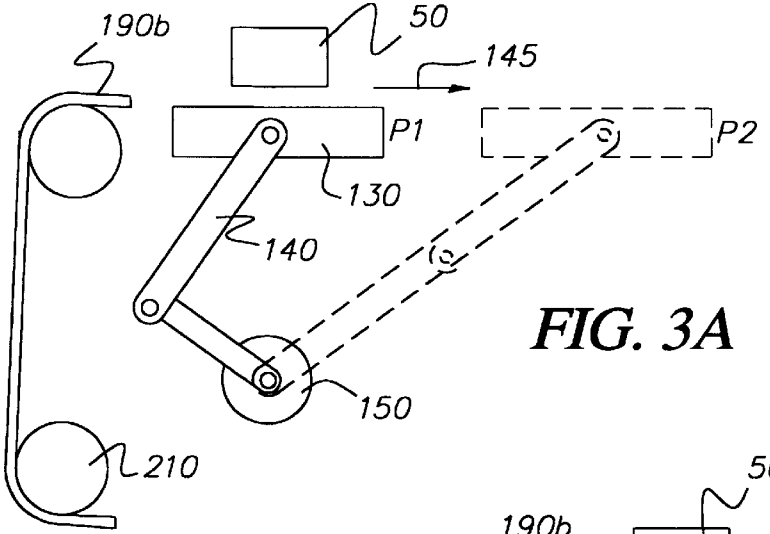
Figure 3C:
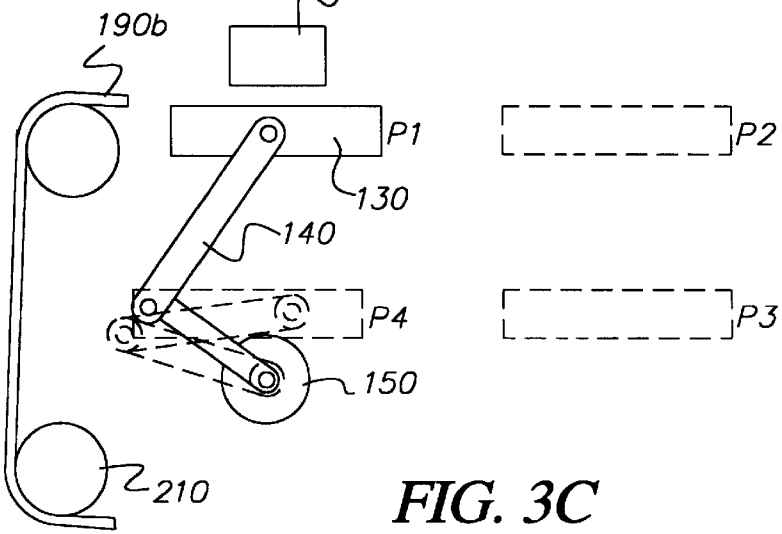

Therefore, referring to FIGS. 1 and 2, there is shown an ink jet printer, generally referred to as 10, for forming an image 20 on a receiver sheet 30 cut to a predetermined length from a roll of receiver 40. As described in more detail hereinbelow, printer 10 is adapted to form image 20 on receiver sheet 30 with no part of image 20 being formed on any of a plurality of transverse sides 45*a* and 45*b* of receiver sheet 30. Receiver sheet 30 has a plurality of marginal edges 46*a* and 46*b* bounding defining a full-width "W" of receiver sheet 30.

Referring again to FIGS. 1 and 2, printer 10 comprises a housing 47 containing a movable print head 50 adapted to eject an image-forming fluid, such as a plurality of ink droplets 60 (see FIG. 6), onto receiver sheet 30 to form image 20 thereon. It may be appreciated that ink droplets 60 may be a dye ink, a pigmented ink, or the like. It also may be appreciated that print head 50 may be a piezoelectric ink jet print head of a type well-known to those skilled in the art. More specifically, print head 50 may be formed of a piezoelectric material, such as lead zirconium titanate (PZT), mechanically responsive to electrical stimuli so that print head 50 deforms when electrically stimulated to eject ink droplets 60, as more fully described presently. In this regard, print head 50 includes a plurality of ink chambers 70, each chamber 70 being defined by a pair of oppositely disposed parallel side walls 80*a* and 80*b*. When any of the pairs of side walls 80*a* and 80*b*are electrically stimulated, such pair of side walls 80*a* and 80*b* simultaneously inwardly move to eject ink droplet 60 from chamber 70 (see FIG. 6). In order to form the desired image 20, the electrical stimuli supplied to print head 50 are controlled such that chambers 70 are selectively actuated for selectively ejecting ink droplets 60 from chambers 70.

Still referring to FIGS. 1 and 2, printer 10 further comprises a first motor 90 for rotating receiver roll 40, such as by means of a shaft 100 connected to first motor 90 and centrally engaging receiver roll 40. As receiver roll 40 rotates, a receiver supply 42 is unwound therefrom to pass between a pair of capstan rollers 110 which guide a desired amount of receiver supply 42 through a cutter blade mechanism 120. When the desired amount of receiver supply 42 passes through cutter blade mechanism 120, the cutter blade mechanism 120 is operated to cut receiver supply 42 in order to form the previously mentioned receiver sheet 30 of predetermined length.

Referring to FIGS. 1, 2, 3A, 3B and 3C, a transport mechanism, generally referred to as 125, engages receiver sheet 30 for transporting receiver sheet 30 relative to print head 50. In this regard, as receiver supply 42 unwinds from receiver roll 40, it passes between capstan rollers 110, through cutter blade mechanism 120 and onto a movable support, such as a movable platen 130, which is disposed near receiver roll 40. Thus, after cutter blade mechanism 120 cuts receiver supply 42 to form receiver sheet 30, momentum of receiver sheet 30 carries receiver sheet 30 onto platen 130 so that receiver sheet 30 comes to rest on platen 130. At this point, platen 130 supports receiver sheet 30. Moreover, an articulated arm 140 is connected to platen 130 for moving platen 130 along a predetermined path 145 relative to print head 50. Thus, it may be understood that receiver sheet 30 moves along predetermined path 145 as platen 130 moves because platen 130 supports receiver sheet 30. Arm 140 moves platen 130 along predetermined path 145 from a first position P1 to a second position P2, whereupon receiver sheet 30 leaves platen 130, as described in detail hereinbelow. However, to receive another receiver sheet 30, platen 130 must be returned to position P1. In this regard, arm 140 is operated such that platen 130 is caused to move from position P3 to position P4. Platen 130 is then caused to move from position P4 and back to position P1 to receive another receiver sheet 30. That is, movement of platen 130 through positions P1, P2, P3, P4 and back to position P1is accomplished by articulated arm 140 which is controllably operated by a suitable second motor 150. Rotation of receiver roll 40, cutting of receiver supply 42, movement of print head 50 and platen 130 and articulation of arm 140 are controlled such that the desired image 20 is formed on receiver sheet 30 and such that receiver sheet 30 leaves platen 130 to be retrieved by an operator of printer 10. For this purpose, a controller 160 is preferably connected to print head 50, first motor 90, cutter blade mechanism 120 and second motor 150 for controlling these components of printer 10 in order to form the desired image 20 of receiver sheet 30 and to present the finished print to the operator of printer 10. Such a controller may be of a type available from Texas Instruments, Incorporated located in Dallas, Tex. It may be understood that print head 50 evinces reciprocating movement orthogonally with respect to platen 130 as platen 130 moves along path 145. More specifically, as platen 130 moves, print head 50 reciprocates between a first position $X_1$ and a second position $X_2$ along a direction illustrated by double-headed arrow 165. This is done in order to print each line of image information forming image 20. Of course, an ink supply 170 is connected to print head 50 for supplying ink to chambers 70 in print head 50.

It is desirable to operate print head 50 such that image 20 extends the full width "W" of receiver sheet 30 in order to provide so-called "borderless"prints, if desired. Borderless prints are aesthetically desirable to the viewer of such a print because distracting borders around image 20 are absent. Also, misaligned images cause uneven borders which are undesirable. Moreover, borderless prints conserve receiver stock because the need to trim away a border surrounding image 20 to obtain a borderless print is avoided. A prior art solution to this problem is simply to begin operating print head 50 such that ink droplets 60 commence ejection beginning at a predetermined distance "d" (see FIG. 6) from transverse sides 45*a* or 45*b* (depending on direction of travel of reciprocating print head 50). This prior art technique avoids the previously mentioned borders and thus provides borderless prints. However, use of this prior art technique gives rise to a problem. That is, when print head 50 is operated in this manner, ink droplets 60 will deposit onto transverse sides 45*a*/*b* and may even migrate to an underside of receiver sheet 30. Deposit of ink onto transverse sides 45*a* and 45*b* as well as onto the underside of receiver sheet 30 detracts from aesthetic enjoyment of image 20. Moreover, commencing ejection of ink droplets 60 before print head 50 aligns with marginal edges 46*a* and 46*b* causes still another problem. In this regard, ink droplets not deposited onto receiver sheet 30 are deposited elsewhere within housing 47 to contaminate components contained therein, a highly undesirable result. It is therefore important to capture ink droplets not deposited onto receiver sheet 30, so that this ink can be later easily removed from printer 10 for disposal or recycling into ink supply 170.

Figure 4:
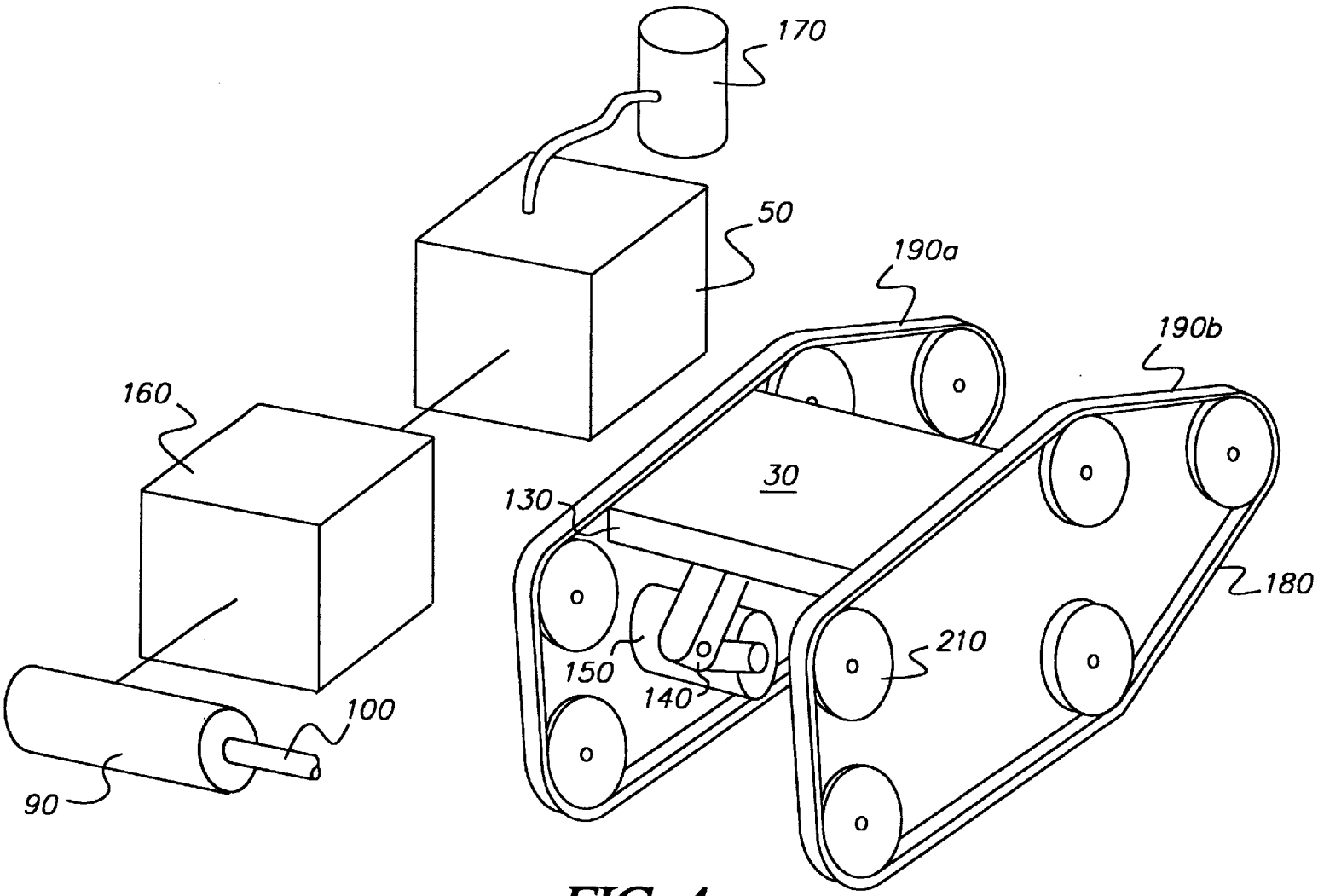
FIG. 4 is a view in perspective of the printer with parts removed for clarity, this view showing a reservoir in the form of a pair of spaced-apart parallel belts.
Figure 5:
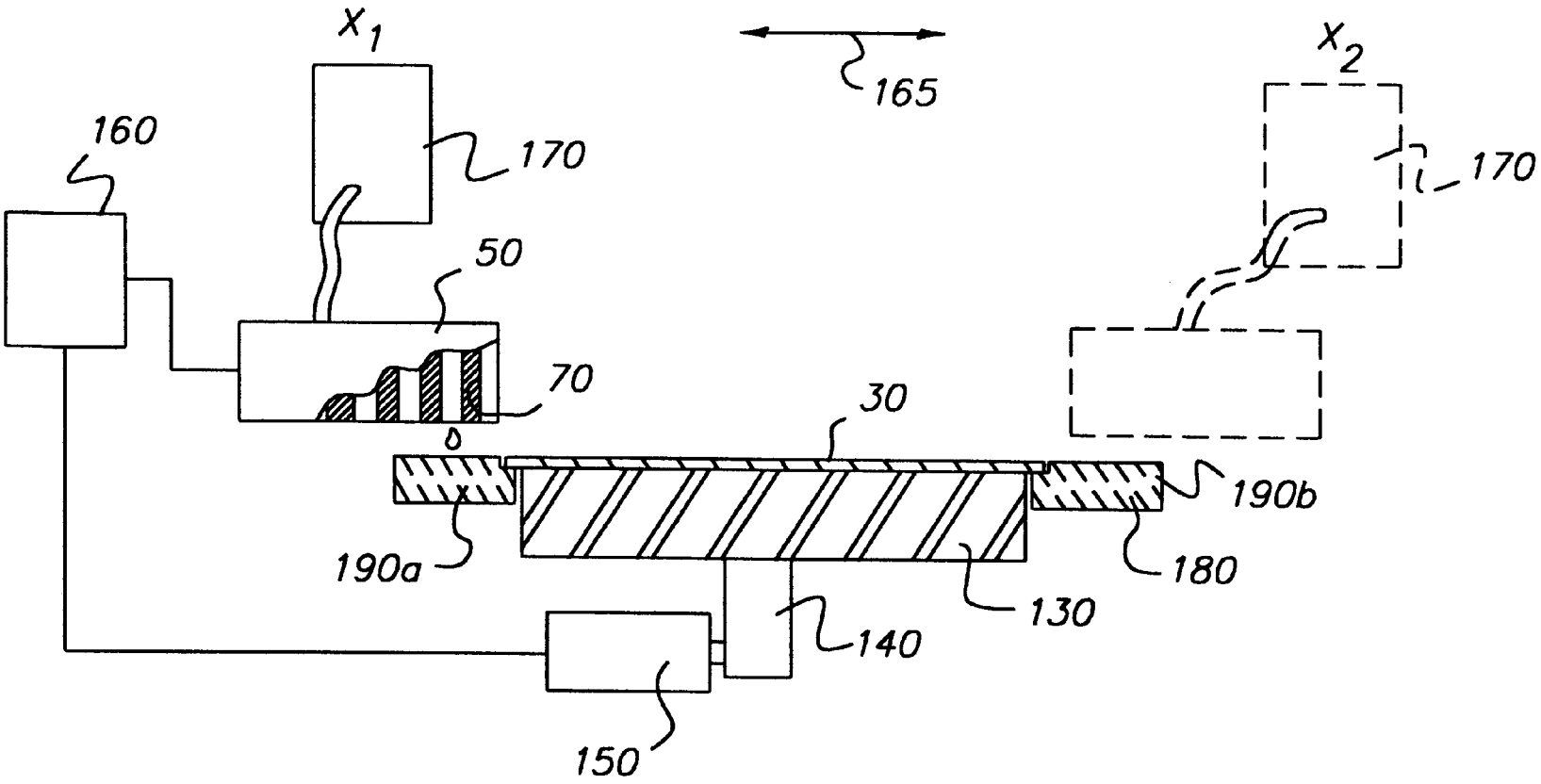
FIG. 5 is a view in elevation of a first embodiment of the reservoir.
Figure 6:
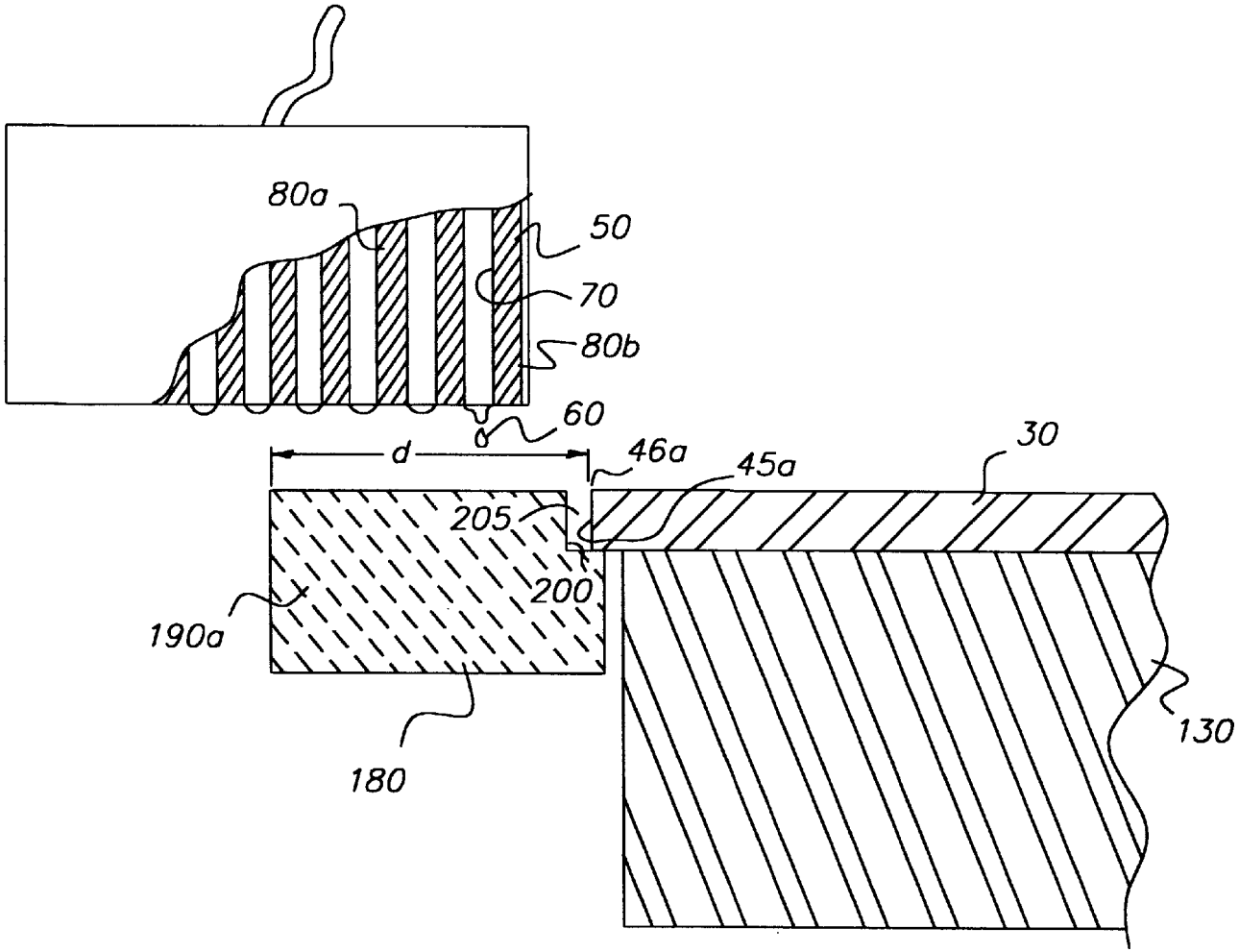
FIG. 6 is an enlarged fragmentation view in elevation of the first embodiment reservoir.

Therefore, referring to FIGS. 4, 5 and 6, a reservoir, generally referred to as 180, extends along predetermined distance "d" for receiving ink droplets 60 ejected along distance "d", so that transverse sides 45*a*/*b* and the underside of receiver sheet 30 are ink-free. Use of reservoir 180 also ensures that ink droplets 60 not deposited onto receiver sheet 30, which ink droplets 60 would otherwise contaminate components within housing 47, are instead captured by reservoir 180. According to a preferred embodiment of the invention, reservoir 180 comprises a pair of spaced-apart parallel belts 190*a* and 190*b*, each belt 190*a*/*b* being formed into a continuous loop (as shown). Extending around an inboard side of each belt 190*a*/*b* may be a lip portion 200 for mounting marginal edges 46*a*/*b* of receiver sheet 30 thereon. Belts 190*a*/*b* are preferable spaced-apart so that a gap 205 is formed between transverse side 45*a*/b and an upright wall of lip portion 200. Gap 205 has a predetermined width that is preferably less than the size of the smallest ink droplet 60 ejected from print head 50 to provide added assurance that no ink droplet 60 will fall into gap 205 and deposit onto transverse side 45*a*/*b*. However, even if some ink droplets 60 were to fall into gap 205, reservoir 180 nonetheless captures ink droplets 60 and draws such ink droplets 60 away from transverse sides 45*a* and 45*b*. In the preferred embodiment of the invention, reservoir 180 is a pad of absorbent material for absorbing, by capillary action, ink droplets 60 that are ejected along distance "d" and that may fall into gap 205. In this manner, no ink droplets 60 are deposited onto transverse sides 45*a*/*b* or elsewhere within housing 47. Ink landing on belts 190*a*/*b* is not only quickly absorbed by belts 190*a*/*b*, but also quickly dries to avoid deposit of the ink on subsequent receiver sheets 30. In this regard, the absorbent material may be a fibrous material, such as a polyester, a reticulated foam with open microscopic cells for receiving fluid, or the like. Of course, absorbent belts 190*a*/*b* may be periodically replaced by an operator of printer 10 once belts 190*a*/*b* become saturated with ink.

Referring again to FIGS. 4, 5 and 6, a plurality of synchronized motorized rollers 210 engage respective ones of belts 190*a*/*b* for simultaneously rotating both belts 190*a*/*b* at the same velocity. Moreover, operation of rollers 210 are synchronized with movement of platen 130, so that belts 190*a*/*b* move in tandem with platen 130. At a point during rotation of belts 190*a*/*b*, receiver sheet 30 will leave belts 190*a*/190*b* to fall by force of gravity (see FIG. 1) into a receiver collection tray 215 for retrieval by an operator of printer 10.

Figure 7:
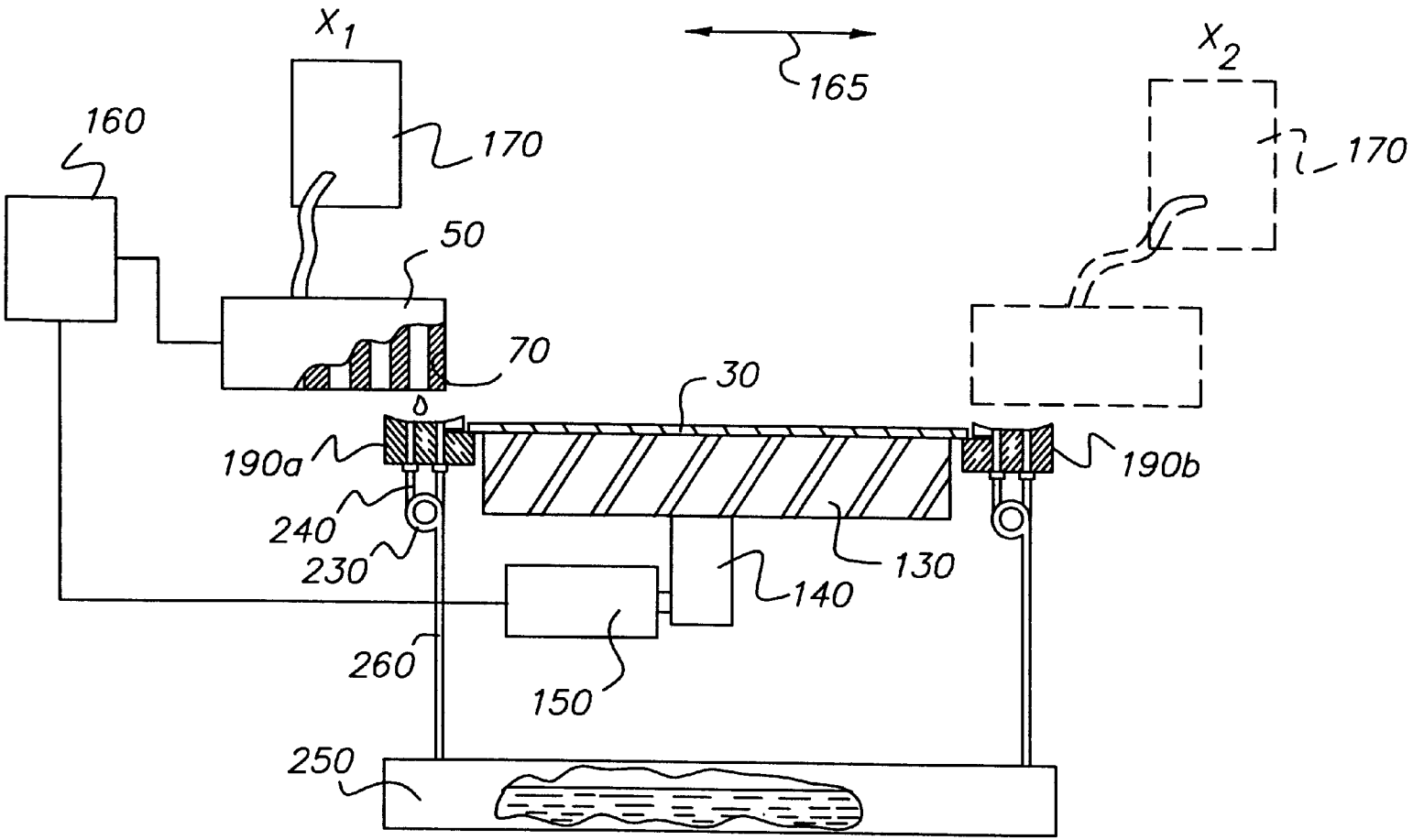
FIG. 7 is a view in elevation of a second embodiment of the reservoir.
Figure 8:
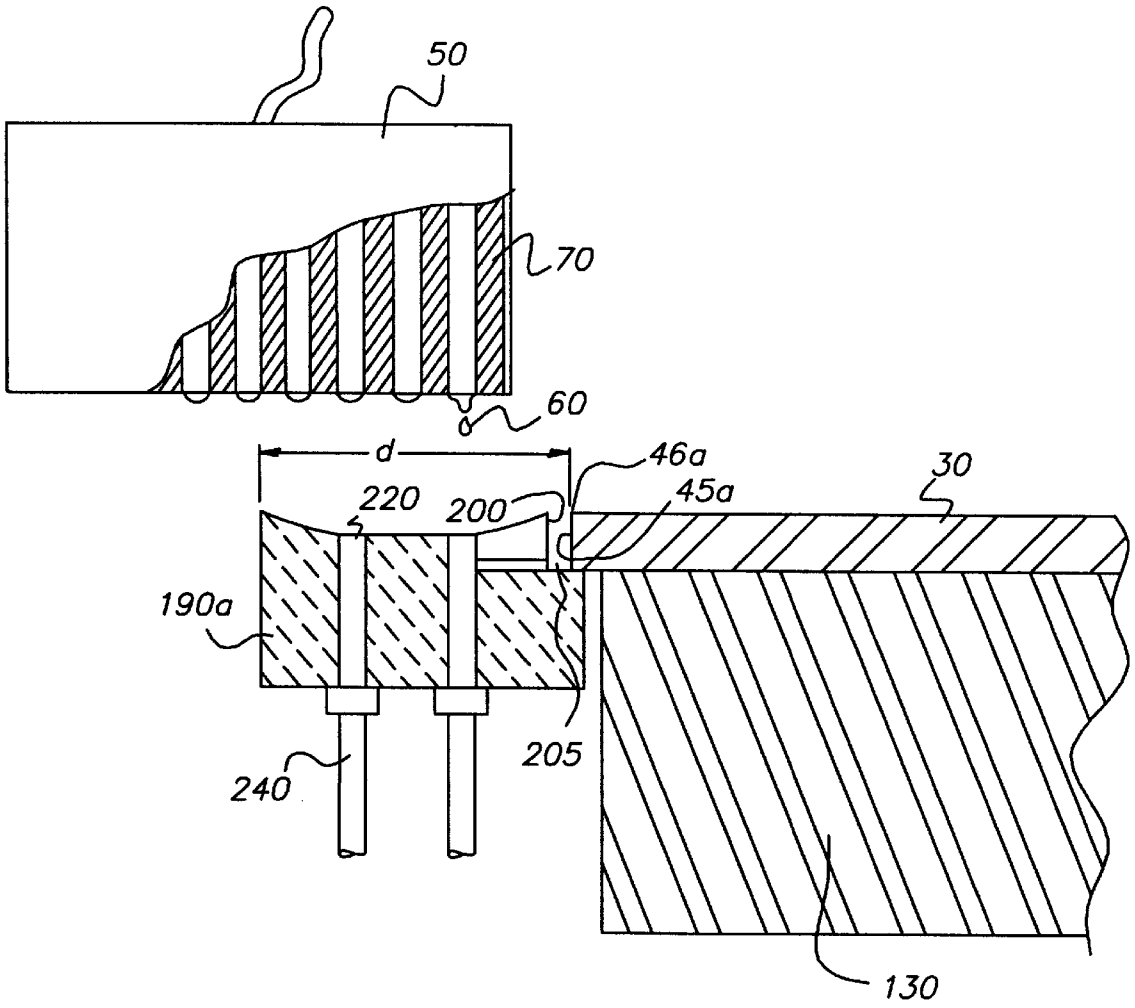
FIG. 8 is an enlarged fragmentation view in elevation of the second embodiment reservoir.

Turning now to FIGS. 7 and 8, a second embodiment of the present invention is there shown. According to this second embodiment of the invention, reservoir 180 comprises a plurality of drains 220 facing print head 50 for receiving ink droplets 60 ejected along predetermined distance "d". To allow efficient collection of these ink droplets 60 ejected along predetermined distance "d", surfaces of reservoir 180 leading to drains 220 may be canted (as shown) to preferentially direct these ink droplets 60 into drain 220. Also, one or more of drains 220 may be in communication with gap 205 for collecting ink droplets that may have fallen into gap 205. Drains 220 are in communication with a suction pump 230, such as by means of a plurality of conduits 240 connected to respective ones of drains 220. The purpose of suction pump 230 is to suction ink droplets 60 through drains 220. Suction pump 230 is connected to a sump 250, such as by means of a pipe 260, which sump 250 receives ink droplets 60 suctioned by suction pump 230. Sump 250 may be periodically emptied by an operator of printer 10 once sump 250 fills with ink.

Figure 9:
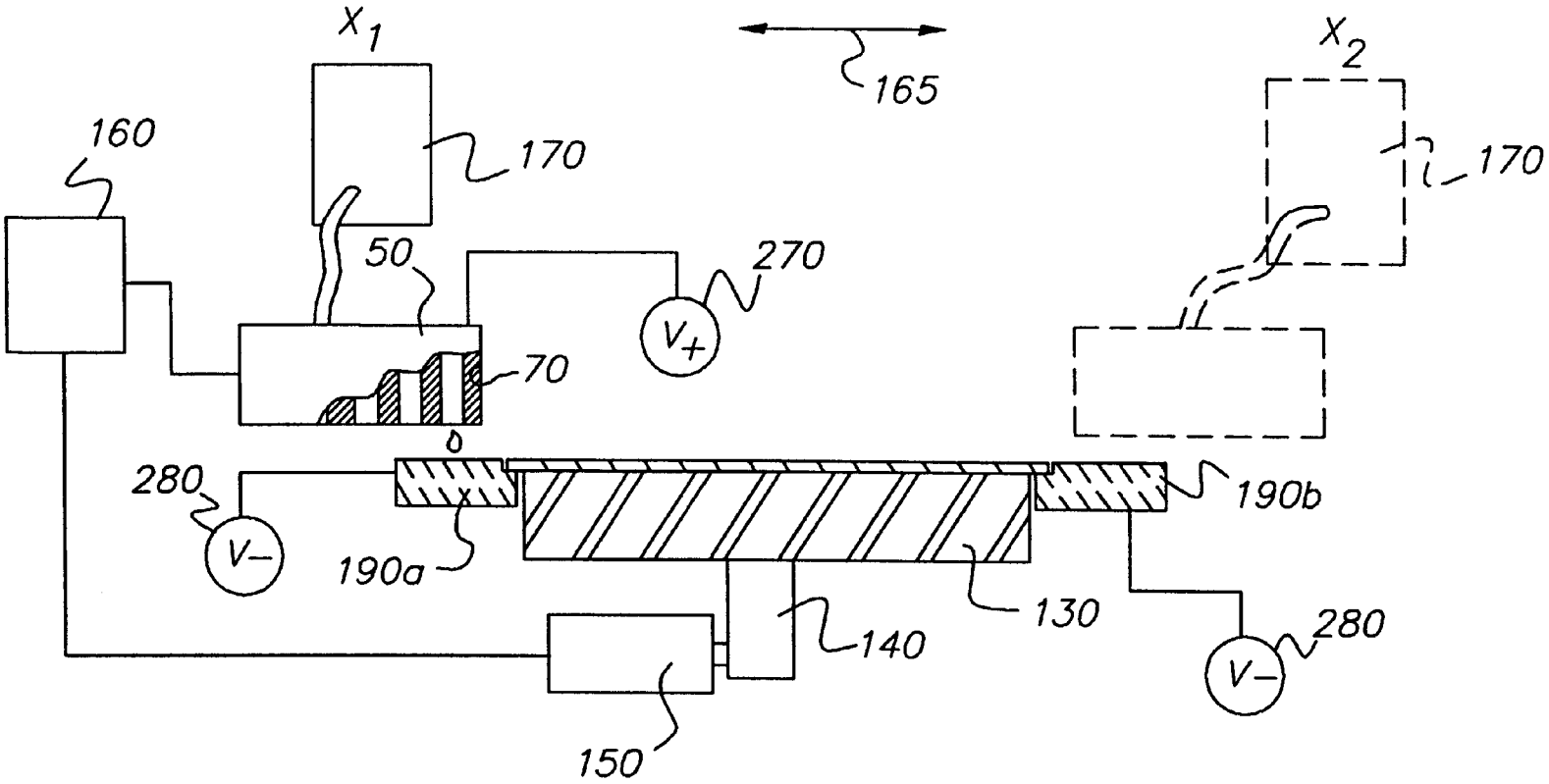
FIG. 9 is a view in elevation of a third embodiment of the reservoir.

As best seen in FIG. 9, a third embodiment of the present invention is there shown. According to this third embodiment of the invention, a first electrostatic source 270 is connected to print head 50 for electrifying ink droplets 60 ejected from channels 70. In this manner, ink droplets 60 obtain a first electrostatic charge of a first polarity (e.g., positive polarity). In addition, a second electrostatic source 280 is connected to reservoir 180 for electrifying reservoir 180, so that reservoir 180 obtains a second electrostatic charge of a second polarity (e.g., negative polarity) opposite the first polarity. In this manner, ink droplets 60 ejected along predetermined distance "d" are electrostatically preferentially attracted to reservoir 180 for capture. Of course, any ink droplets 60 falling into gap 205 are drawn to reservoir 180 and away from transverse sides 45*a*/*b* because such ink droplets are electrostatically attracted to reservoir 180.

It may be appreciated from the description hereinabove, that an advantage of the present invention is that use thereof provides borderless prints without transverse side contamination in order to enhance aesthetic enjoyment of image 20 formed on receiver sheet 30. That is, production of borderless prints are now possible without ink being deposited on transverse sides 45*a*/*b* or on the underside of receiver sheet 30. This result is in turn due to ink ejected along distance "d" being captured by reservoir 180.

It may be appreciated from the description hereinabove, that another advantage of the present invention is that use thereof avoids ink contamination of components within printer 10 during production of borderless prints. This is so because ink ejected along distance "d" is easily captured by reservoir 180 for later disposal or recycling.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, the reservoir may be a radiant heater which evaporates the ink droplets ejected along the predetermined distance, such that no liquid ink droplets fall onto the transverse sides of the receiver sheet. Any ink particulate matter resulting from the evaporation process will deposit onto the reservoir for later disposal. In this instance, the reservoir may be coated with a suitable adhesive to bound the falling particulate matter to the reservoir to avoid migration of the particulates to the print or printer components and also for ease of disposal.

Therefore, what is provided is an ink jet printer for forming a full-width image on a receiver exclusive of a transverse side of the receiver, and method of assembling the printer, such that inadvertent deposit of ink on the transverse side and elsewhere in the printer is avoided.

PARTS LIST d . . . distance from transverse side of receiver sheet
W . . . width of receiver sheet
$X_1$ . . . first position of print head 50
$X_2$ . . . second position of print head 50
10 . . . printer
20 . . . image
30 . . . receiver sheet
40 . . . roll of receiver
42 . . . receiver supply
45*a/b* . . . transverse sides (of receiver sheet)
46*a/b* . . . marginal edges (of receiver sheet)
47 . . . housing
50 . . . print head
60 . . . ink droplets
70 . . . ink chambers
80*a/b* . . . side walls
90 . . . first motor
100 . . . shaft
110 . . . capstan rollers
120 . . . cutter blade mechanism
125 . . . transport mechanism
130 . . . platen
140 . . . articulated arm
145 . . . predetermined path (of receiver sheet travel)
150 . . . second motor
160 . . . controller
165 . . . arrow
170 . . . ink supply
180 . . . reservoir
190*a/b* . . . belts
200 . . . lip portion
210 . . . rollers
215 . . . receiver collection tray
220 . . . drain
230 . . . suction pump
240 . . . conduits
250 . . . sump
260 . . . pipe
270 . . . first electrostatic source
280 . . . second electrostatic source

What is claimed is:

1. A printer for forming an image on a receiver exclusive of a transverse side of the receiver, comprising:

(a) a print head adapted to eject an image-forming fluid therefrom commencing a predetermined distance from the transverse side for forming the image on the receiver;

(b) a reservoir associated with said print head and extending along the predetermined distance for receiving the fluid ejected along the predetermined distance, such that the transverse side is fluid-free;

(c) a first electrostatic source connected to said print head for electrifying the fluid therein with a first polarity; and (d) a second electrostatic source connected to said reservoir for electrifying said reservoir with a second polarity opposite the first polarity, whereby the fluid ejected along the predetermined distance is preferentially attracted to said reservoir.

2. The printer of claim 1, wherein said reservoir comprises an absorbent pad for absorbing the fluid ejected along the predetermined distance.

3. The printer of claim 2, wherein said pad is formed of a fibrous material.

4. The printer of claim 1, wherein said reservoir comprises a drain for receiving the fluid thereinto.

5. The printer of claim 1, further comprising a transport mechanism engaging the receiver for transporting the receiver relative to said print head.

6. The printer of claim 5, wherein said transport mechanism comprises:

(a) a support for supporting the receiver thereon; and (b) an articulated arm connected to said support for moving said support along a predetermined path, so that the receiver moves along the predetermined path as the support moves.

7. A printer for forming an image on a receiver sheet exclusive of a transverse side of the receiver sheet, comprising:

(a) a print head adapted to eject a plurality of ink droplets commencing a predetermined distance from the transverse side for forming the image on the receiver sheet;

(b) a movable support engaging the receiver sheet for supporting the receiver sheet thereon;

(c) a reservoir disposed relative to said print head and extending along the predetermined distance for receiving the ink droplets ejected along the predetermined distance, so that the image forms only on the receiver sheet and so that the transverse side is free of ink droplets;

(d) a first electrostatic source connected to said print head for electrifying the ink droplets ejected therefrom, so that the ink droplets have a first electrostatic charge of a first polarity; and (e) a second electrostatic source connected to said reservoir for electrifying said reservoir, so that the reservoir has a second electrostatic charge of a second polarity opposite the first polarity, whereby the ink droplets ejected along the predetermined distance are preferentially attracted to said reservoir.

8. The printer of claim 7, wherein said reservoir comprises an absorbent pad made of fibrous material for absorbing the ink droplets ejected along the predetermined distance.

9. The printer of claim 7, wherein said reservoir comprises:

(a) a drain for receiving the ink droplets thereinto;

(b) a suction pump connected to said drain for suctioning the ink droplets received into said drain; and (c) a sump connected to said pump for receiving the ink droplets suctioned by said pump.

10. The printer of claim 7, further comprising:

(a) an articulated arm connected to said support for moving said support along a predetermined path, so that the receiver moves along the predetermined path as the support moves; and (b) a motor engaging said arm for articulating said arm.

11. The printer of claim 7, wherein said reservoir comprises a pair of spaced-apart belts having the receiver sheet interposed therebetween, each belt being formed into a loop and engaging the receiver sheet.

12. The printer of claim 11, further comprising a plurality of motorized rollers engaging respective ones of said belts for rotating said belts, said rollers capable of rotating said belts so that said belts move in tandem with said support.

13. A method of assembling a printer for forming an image on a receiver exclusive of a transverse side of the receiver, comprising the steps of:

(a) providing a print head adapted to eject an image-forming fluid therefrom commencing a predetermined distance from the transverse side for forming the image on the receiver;

(b) disposing a reservoir relative to the print head, the reservoir extending along the predetermined distance for receiving the fluid ejected along the predetermined distance, such that the transverse side is fluid-free;

(c) connecting a first electrostatic source to the print head for electrifying the fluid therein with a first polarity; and (d) connecting a second electrostatic source to the reservoir for electrifying the reservoir with a second polarity opposite the first polarity, whereby the fluid ejected along the predetermined distance is preferentially attracted to the reservoir.

14. The method of claim 13, wherein the step of disposing a reservoir comprises the step of disposing an absorbent pad for absorbing the fluid ejected along the predetermined distance.

15. The method of claim 14, wherein the step of disposing an absorbent pad comprises the step of disposing an absorbent pad formed of a fibrous material.

16. The method of claim 13, wherein the step of disposing a reservoir comprises the step of disposing a drain for receiving the fluid thereinto.

17. The method of claim 13, further comprising the step of engaging a transport mechanism with the receiver for transporting the receiver relative to the print head.

18. The method of claim 17, wherein the step of engaging a transport mechanism comprises the step of:

(a) providing a support for supporting the receiver thereon; and (b) connecting an articulated arm to the support for moving the support along a predetermined path, so that the receiver moves along the predetermined path as the support moves.

19. A method of assembling a printer for forming an image on a receiver sheet exclusive of a transverse side of the receiver, comprising the steps of:

(a) providing a print head adapted to eject a plurality of ink droplets commencing a predetermined distance from the transverse side for forming the image on the receiver sheet;

(b) engaging a movable support with the receiver sheet for supporting the receiver sheet thereon;

(c) disposing a reservoir relative to the print head, the reservoir extending along the predetermined distance for receiving the ink droplets ejected along the predetermined distance, so that the image forms only on the receiver sheet and so that the transverse side is free of ink droplets;

(d) connecting a first electrostatic source to the print head for electrifying the ink droplets ejected therefrom, so that the ink droplets have a first electrostatic charge of a first polarity; and (e) connecting a second electrostatic source to the reservoir for electrifying the reservoir, so that the reservoir has a second electrostatic charge of a second polarity opposite the first polarity whereby the ink droplets ejected along the predetermined distance are preferentially attracted to the reservoir.

20. The method of claim 19, wherein the step of disposing a reservoir comprises the step of disposing an absorbent pad made of fibrous material for absorbing the ink droplets ejected along the predetermined distance.

21. The method of claim 19, wherein the step of disposing a reservoir comprises the steps of:

(a) providing a drain for receiving the ink droplets thereinto;

(b) connecting a suction pump to the drain for suctioning the ink droplets received into the drain; and (c) connecting a sump to the pump for receiving the ink droplets suctioned by the pump.

22. The method of claim 19, further comprising the steps of:

(a) connecting an articulated arm to the support for moving the support along a predetermined path, so that the receiver sheet moves along the predetermined path as the support moves; and (b) engaging a motor with the arm for articulating the arm.

23. The method of claim 19, wherein the step of disposing a reservoir comprises the step of disposing a pair of spaced-apart belts having the receiver sheet interposed therebetween, each belt being formed into a loop and engaging the receiver sheet.

24. The method of claim 23, further comprising the step of engaging a plurality of motorized rollers with respective ones of the belts for rotating the belts, the rollers capable of rotating the belts so that the belts move in tandem with the support.

* * * * *